United States Patent [19]

Schöniger et al.

[11] Patent Number: 4,903,172

[45] Date of Patent: Feb. 20, 1990

[54] DISPLAY CONSTRUCTION

[76] Inventors: Karl-Heinz Schöniger, Barbarossastr., 40/6, 7300 Esslingen; Winfried Scheid, Ringweg 14, 7333 Ebersbach, both of Fed. Rep. of Germany

[21] Appl. No.: 243,465

[22] Filed: Sep. 12, 1988

[30] Foreign Application Priority Data

Sep. 11, 1987 [DE] Fed. Rep. of Germany ..... 3730591

[51] Int. Cl.[4] ..... F21V 7/04

[52] U.S. Cl. ..... 362/31; 362/84; 362/183; 362/802; 362/812; 40/546

[58] Field of Search ..... 362/31, 84, 183, 802, 362/812; 40/546, 547, 900

[56] References Cited

U.S. PATENT DOCUMENTS

| | | | |
|---|---|---|---|
| 3,316,435 | 4/1967 | Kelso | 362/84 |
| 3,497,686 | 2/1970 | Young | 40/546 |
| 4,009,535 | 3/1977 | Stock | 40/546 |
| 4,573,766 | 3/1986 | Bournay, Jr. et al. | 362/31 |
| 4,715,137 | 12/1987 | Scheve | 40/546 |
| 4,744,012 | 5/1988 | Bergkuist | 362/84 |
| 4,779,166 | 10/1988 | Tanaka et al. | 362/31 |
| 4,782,432 | 11/1988 | Coffman | 362/183 |

FOREIGN PATENT DOCUMENTS

| | | | |
|---|---|---|---|
| 2705920 | 8/1978 | Fed. Rep. of Germany | 362/84 |
| 175450 | 5/1961 | Sweden | 362/31 |

*Primary Examiner*—Stephen F. Husar
*Assistant Examiner*—Sue Hagarman
*Attorney, Agent, or Firm*—McGlew & Tuttle

[57] ABSTRACT

An illuminated display unit such as a house number, traffic sign, advertisement carrier and the like comprises a fluorescing or photoconductive plate adjacent an edge of which is fitted at least one light-emitting element, in particular a light-emitting diode. The edge is provided with a reflecting layer to prevent emergence of light. Display symbols or their negatives are arranged, as viewed by the onlooker, on the rear face of the photoconductive plate. As a result of the total reflection for a photoconductive plate on the front and back and on the reflecting layer at the edges, the light produced by the light-emitting diode can issue only at the contact surface with the display symbols, so that the light is concentrated very strongly there and a great display brightness is produced. This is even more effective when a contrast surface is arranged behind the plate. In this way great display brightness can be produced with very low electric power, permitting continuous operation or operation with a small number of solar cells.

4 Claims, 2 Drawing Sheets

DISPLAY CONSTRUCTION

FIELD AND BACKGROUND OF THE INVENTION

This invention relates in general to illuminated display units and in particular to a new and useful display unit to be used as a house number, traffic sign, advertisement carrier or the like, having a fluorescing photoconductive plate, into which is fitted at least one light-emitting diode at at least one lateral limiting edge.

Such a display unit is known from German OS 33 22 393. In the light fixture described therein, light-emitting diodes are inserted into a diffusing lens from the narrow edges so as to admit the light into the lens as fully as possible. It can be inferred from FIG. 1 that thereby a symbol is illuminated from behind, so that a contrast results. In such a case however, the light yield is very small, so that this arrangement is not suitable for example for relatively large display areas.

Also from U.S. Pat. No. 4,373,284 or U.S. Pat. No. 4,484,104 it is known, for example, how to illuminate the plate carrying the respective symbols from behind, so that the information stands out through different coloration or different light transmission. Further it is known practice to form the symbols themselves, for example a legend, by an appropriately formed light-emitting tube according to Swiss Patent 168,894, or according to German patent 30 49 064 light-emitting elements are strung together according to the shape of the symbols.

All of the known display units have the disadvantage of relatively high current consumption, so that when operating with solar cells, a large number of solar cells and a large storage capacity are required.

Further, from German OS 36 02 819 a display unit is known where the light-emitting elements are incorporated in a fluorescing photoconductive plate so as to illuminate display symbols from behind. This known solution does indeed represent an improvement over the previous solutions with respect to energy requirement but it is still not low enough. Another disadvantage is that the photoconductive plate must have a curved reflection surface, so that commercially available plates cannot be used and manufacture becomes complex and expensive. Without this curved reflection surface a fairly uniform illumination of large display areas would not be ensured.

It is indeed known from German OS 23 56 947 to apply symbols on the back of a transparent plate, but also with this known arrangement the light yield is very low, as the light must enter from the side through an outside edge of the plate with losses by reflection, and no contrast area is provided. Moreover, in ordinary transparent plates no special emergence of light at contact points is observable.

SUMMARY OF THE INVENTION

The invention provides an illuminated display unit which, combined with improved light yield, ensures a more uniform illumination and also larger display areas.

The invention makes use of the fact that light can emerge from a fluorescing photoconductive plate essentially only at contact points or interface edges. As all lateral boundary edges are provided with a reflecting layer, light cannot issue there, but is reflected back into the plate. Hence, light can issue only at the point where the display symbols or their negatives are applied, namely at the rear surface of the photoconductive plate. These points are thereby uniformly illuminated very intensively from all sides by the light distributed in the photoconductive plate and thus become very well visible when viewed through the photoconductive plate, this being further improved by the contrast surface behind it. As the entire light is focused onto these points almost without loss, the light yield is very good. In contrast for example to the arrangements known from German OS 36 02 819 or U.S. Pat. No. 4,484,104, in which the symbols are illuminated indirectly from behind, here direct illumination of the symbols to be displayed is ensured, that is, the visible areas are illuminated directly from the front. Due to this good light yield, energy-saving operation of such display units is possible, so that, for example, a house number can be displayed by a very small number of solar cells at low storage capacity of a battery and even using a single light-emitting diode. If current is supplied from the outside, long-term operation is possible because of the low consumption, so that additional switching measures can be dispensed with.

The display symbols or their negatives may be formed inexpensively as closely adhering foils, which to achieve intimate contact are glued onto the back of the photoconductive plate or are formed as an adhesive foil. Alternatively they may be formed as a vapor-deposited coating or be fashioned, in particular cut, into the photoconductive plate.

For current supply, appropriately at least one slanting sidewall of the housing and/or the reflecting layer on the front surface of the photoconductive plate and/or the contrast surface is provided with solar cells. In the latter case the solar cells are illuminated through the photoconductive plate, for which purpose especially solar cells for diffuse light are suitable. To store the solar energy irradiated during the day, the housing includes a chargeable battery, associated with a charging device operated by the solar cell.

For additional saving of electric energy, for example, in the case of very small solar cell units or, as compared with them, very large photoconductive plates, the display unit is appropriately provided with a twilight switch which turns the light-emitting elements on only below a predeterminable outdoor brightness.

Accordingly it is an object of the invention to provide a display unit such as a house number, traffic sign, advertisement device, etc. which comprises a photoconductive plate which has a front viewing face and an opposite rear face and an edge with at least one electrical light-emitting element arranged adjacent the edge of the plate and including display symbols on the plate provided with a reflecting layer and having fluorescing particles forming a wall in the front region of the display unit, and a contrast wall behind this front wall.

A further object of the invention is to provide a display device in which a diode arranged alongside an edge of a display plate illuminates a fluorescing display area and which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

DESCRIPTION OF THE PREFERRED EMBODIMENTS

Figure 1:
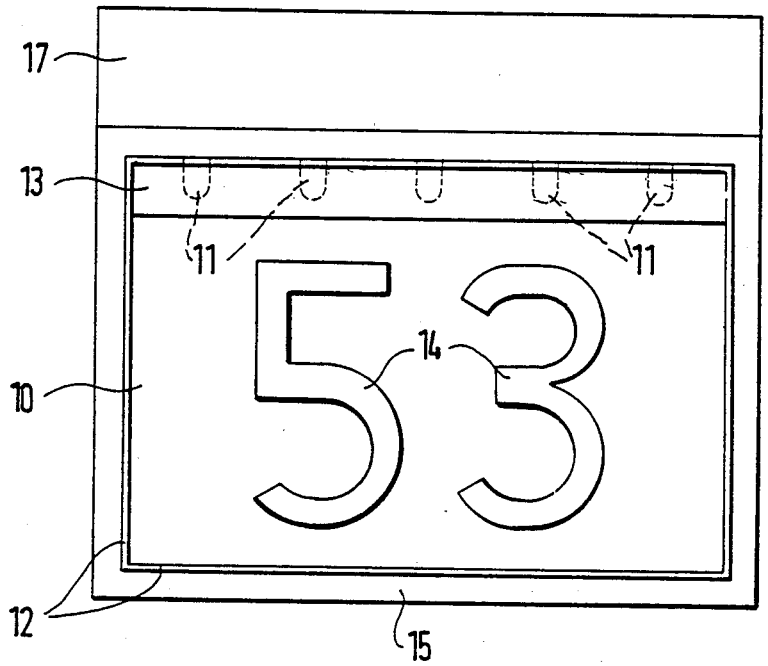
FIG. 1 is a front view of a display unit constructed in accordance with the invention.

Referring to the drawings in particular the invention embodied therein comprises a display unit which in the embodiment illustrated comprises a house number display which includes a housing 15 having a rear wall 16 which forms a contrast wall and an inner end of a cavity in the housing which contains a photoconductive plate 10. In accordance with the invention the plate 10 has an interior wall which carries a reflecting layer 13 which is illuminated by light-emitting elements 11 which are advantageously low energy consuming diodes which may be activated such as by solar cell 17 or a battery 19 which may be kept to charge by a charging device 20.

Figure 2:
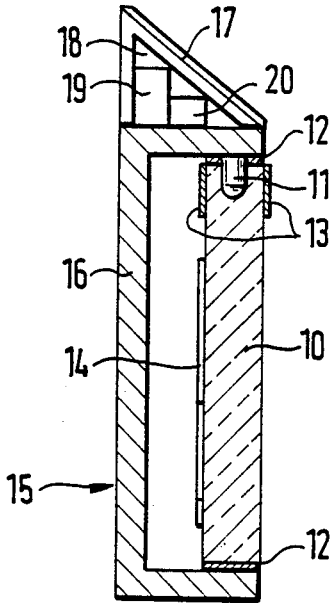
FIG. 2 shows the same display unit in transverse section.

In the embodiment illustrated in FIGS. 1 and 2, the display area is formed by a rectangular, fluorescing photoconductive plate 10 of a thickness of 8 mm for example. Such photoconductive plates ordinarily consist of glass-clear plastic colored with fluorescent pigment or a material mixed with fluorescing particles. Such photoconductive plates have the property of radiating absorbed light by fluorescence out again. The fluorescence radiation is conducted by total reflection to the limiting edges and is radiated from there in concentrated form, unless measures preventing this are provided. Besides, light emergence occurs at those points where other bodies come in close contact with the photoconductive plate.

At the upper limiting edge of the photoconductive plate 10, five light-emitting diodes 11, arranged essentially at equal intervals, are embedded in corresponding recesses in the photoconductive plate 10. The number of light-emitting diodes used may, of course, be any number and depends on the desired brightness. Generally a single light-emitting diode is sufficient e.g. for a house number if the arrangement described below is provided. Also the remaining edges may, of course, be provided with embedded light-emitting diodes. This is desirable especially for photoconductive plates of very large area.

To prevent emergence of light at the four limiting edges, the edges are provided with a reflecting layer 12. In the simplest case this may be an aluminum foil, or it may be metallized by coating or vapor deposition. In any event it is found to be desirable to smooth the limiting edges very well before application of the reflecting layer 12, preferably to polish them, so as to obtain close contact with the reflecting layer and a good reflection capacity. In addition, the front and back of the photoconductive plate 10 are provided in the area of the light-emitting diodes 1 with a strip-like reflecting layer 13, to prevent direct emergence of light. This reflecting layer 13 covers an area such that the total reflection on the front and back is maintained.

On the back of the photoconductive plate 10, the numbers 5 and 3 are applied as display symbols 14. These may either be formed as adhesive foils or they may be glued on in foil form. What is important is that a very intimate contact with the photoconductive plate 10 occurs, which permits emergence of light at the contact points. Naturally the display symbols 14 may alternatively be produced by coating, in particular by vapor deposition.

Preferably the display symbols are of a bright color, so that the light emerging there will be absorbed as little as possible. The display symbols thus illuminated are well recognizable through the transparent photoconductive plate 10. Naturally it is possible also to produce a negative of these display symbols, that is, the entire back of the photoconductive plate 10 is provided with a closely adhering layer 10, from which only the numerals, letters or the like are blocked out.

The photoconductive plate 10 is placed in a box type housing 15, the front wall being formed by the photoconductive plate 10 itself, while the rear wall 16 in spaced relation thereto constitutes a contrast surface. Alternatively the photoconductive plate may be simply arranged in the front region of a housing type display unit and covered by a transparent wall for its protection, which covering may extend also over the sides. If the display symbols 14 are in bright colors, the contrast surface is appropriately colored dark, while for display symbols formed as negatives the contrast surface is colored bright. At the top of the housing 15 an inclined solar cell unit 17 is arranged, a favorable angle of inclination being for example 70°, depending on the geographic location. In the space 18 formed between the solar cell unit 17 and the housing 15, a chargeable battery 19 as well as a charging device 20 are arranged. These may, of course, be arranged alternatively in the housing 15 and be colored in accordance with the contrast surface or be provided with a corresponding covering.

It is further possible to provide solar cells on the reflecting layer 13 on the front surface of the photoconductive plate 10. Another favorable place is the contrast surface, that is, the rear wall 16 in the interior of the housing 15. For this it is preferable to use solar cells suitable for diffused light. Here the light can get to the solar cells through the transparent photoconductive plate 10. If the light yield is sufficient, the inclined solar cell unit 27 may be omitted.

The display symbols may also be fashioned, in particular cut, into the photoconductive plate. At the bevel edges thus produced, the light can emerge, owing to which the respective display symbols 14 stand out brightly.

Figure 3:
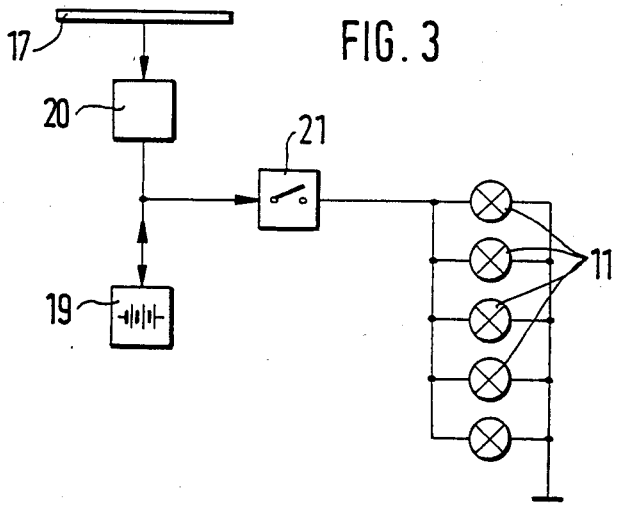
FIG. 3, a block diagram of an electronic circuit appropriately to be used.

In FIG. 3 is shown a block diagram of the electric circuit. The electric energy generated in the solar cell unit 17 is supplied to the chargeable battery 19 for energy storage via the charging device 20 designed for example as a current source. In this manner, a constant charging current is ensured to protect the battery. Depending on the desired voltage, the charging device 10 may be provided further with a voltage transformer. The battery 19 is connected to the five light-emitting diodes 11 via a twilight switch 21. During the day this twilight switch 21 is open, so that the battery 19 can be charged without current drain. It is only below a presettable outdoor brightness, which is determined e.g. via pickup of the electric energy generated by the solar cell unit 17 or by another photo semiconductor (not shown) that the twilight switch 21 closes and that the light-emitting diodes 11 are powered by the battery 19. For this purpose, for example, the current generated by the solar cell unit 17 can be supplied to a threshold device, the light-emitting diodes 11 or a single light-emitting diode being turned on when a pre-settable threshold value is passed. If the solar cell units are large enough; and light irradiation is sufficient, the twilight switch 21 may be omitted or it may be replaced for example, by a manually operated switch.

Rather than being operated by solar cells, the light-emitting diodes 11 may be powered in conventional manner through a low-voltage line from the outside. As the energy requirement of this display unit is extremely small, the light-emitting diode may then remain turned on continuously, so that switching devices can be dispensed with.

As a modification of the embodiment example illustrated, the photoconductive plate 10 may of course have a different form, being, e.g. round, oval or triangular While a specific embodiment of the invention has been shown and described in detail to illustrate the application of the principles of the invention, it will be understood that the invention may be embodied otherwise without departing from such principles.

What is claimed is:

1. An illuminated display unit, in particular of the type including one of a house number, traffic sign, advertisement device, which display unit comprises:

a photoconductive fluorescent plate which has a front viewing face, and an opposite fear face and a peripheral edge extending between the faces;

a display symbol in engagement with said rear face;

at least one light-emitting element inserted into a portion of the edge of the plate for directing light into the plate thereby illuminating the plate and the display symbol;

a reflecting layer extending along the peripheral edge for reflecting light from within the plate incident on such edge, internally, a contrast wall mounted behind the rear face of the plate forming a rear housing wall;

reflecting layers arranged along said front and rear faces adjacent said edge portion between which reflecting layers the light-emitting element is disposed;

said light-emitting element including a light-emitting diode arrangement, a chargeable battery connected to said diode arrangement, a charging device connected to said battery and a solar cell connected to said charging device, operating said charging device.

2. An illuminated display unit, in particular of the type including one of a house number, traffic sign, advertisement device, which display unit comprises:

a housing having front and rear walls and a top wall with an inclined surface extending between planes containing said front and rear wall;

a photoconductive fluorescent plate forming the front wall which photoconductive fluorescent plate has a front viewing face, and an opposite rear face and a peripheral edge extending between the faces;

a display symbol formed by a layer engaging over said rear face;

at least one light-emitting element inserted into a portion of the edge of the plate for directing light into the plate thereby illuminating the plate and the display symbol;

metal-luster reflecting layer extending along the peripheral edge for reflecting light from within the plate incident on such edge, internally;

a contrast wall mounted behind the rear face of the plate forming a rear housing wall:

metal-luster reflecting layers arranged along said front and rear faces adjacent said edge portion between which reflecting layers the light-emitting element is disposed:

said light-emitting element including a light-emitting diode arrangement, a chargeable battery connected to said diode arrangement, a charging device connected to said battery and a solar cell carried by the top wall surface and connected to said charging device, operating said charging device.

3. A display unit according to claim 2, including a twilight switch connected between said charging device and said battery and said diode and operated by electric energy provided by said solar cell switches, to turn on at least one light-emitting element when the ambient illumination drops below a predetermined brightness.

4. A display unit according to claim 2 wherein the symbol and the reflecting layer are each made of foil.

* * * * *